US007071959B2

(12) United States Patent
Kato et al.

(10) Patent No.: US 7,071,959 B2
(45) Date of Patent: Jul. 4, 2006

(54) METHOD AND APPARATUS FOR ARRANGING LIGHT-EMITTING DIODES AND LIGHT-EMITTING ELEMENTS

(75) Inventors: Hideaki Kato, Aichi (JP); Koichi Kaga, Aichi (JP); Kanae Matsumura, Aichi (JP)

(73) Assignee: Toyoda Gosei Co., Ltd., Aichi (JP)

( * ) Notice: Subject to any disclaimer, the term of this patent is extended or adjusted under 35 U.S.C. 154(b) by 77 days.

(21) Appl. No.: 10/615,340

(22) Filed: Jul. 9, 2003

(65) Prior Publication Data

US 2004/0113869 A1 Jun. 17, 2004

(30) Foreign Application Priority Data

Jul. 10, 2002 (JP) ..... P2002-201358

(51) Int. Cl.
*B41J 2/435* (2006.01)
*G09G 3/14* (2006.01)

(52) U.S. Cl. ..... 347/130; 347/237; 347/118; 345/46; 345/82

(58) Field of Classification Search ..... 315/156, 315/158, 159, 149, 291, 294, 200 A, 312; 345/46, 63, 48, 84, 55, 77, 83, 102, 31, 82, 345/113; 250/205, 214 R; 347/237, 247, 347/130, 118, 238
See application file for complete search history.

(56) References Cited

U.S. PATENT DOCUMENTS 4,367,932 A * 1/1983 Ishikawa et al. ..... 396/61
5,567,937 A * 10/1996 Pinkus ..... 250/252.1
5,995,070 A * 11/1999 Kitada ..... 345/83
6,344,641 B1 * 2/2002 Blalock et al. ..... 250/205
6,433,809 B1 * 8/2002 Kodama ..... 347/233
6,469,727 B1 * 10/2002 Wada et al. ..... 347/240
6,473,062 B1 * 10/2002 Debiez et al. ..... 345/63
6,618,123 B1 * 9/2003 Uomori et al. ..... 356/3.12
6,753,897 B1 * 6/2004 Vazan ..... 347/237
2001/0007470 A1 * 7/2001 Haavisto ..... 348/223
2003/0034282 A1 * 2/2003 Safai ..... 209/582
2004/0160199 A1 * 8/2004 Morgan et al. ..... 315/312
2005/0111016 A1 * 5/2005 Yoneyama et al. ..... 358/1.9

FOREIGN PATENT DOCUMENTS

JP 5-40147 2/1993
JP 8-255820 10/1996
JP 2001-24226 1/2001
JP 2001-38960 2/2001

* cited by examiner

*Primary Examiner*—Don Wong
*Assistant Examiner*—Chuc Tran
(74) *Attorney, Agent, or Firm*—McGinn IP Law Group, PLLC

(57) ABSTRACT

After measurement, light-emitting elements are temporarily numbered (1), . . . in measuring order and arranged successively on a temporary palette. In parallel with this operation, measured light intensity data are input to a computer system in association with the temporary numbers (1), . . . In the computer system, the measured light intensity data are rearranged according to predetermined algorithm to make the light intensity values of adjacent light-emitting elements substantially equal, so that the temporary numbers (1), . . . are rearranged on a memory in accordance with the rearranged data. The rearranged data are sent from the computer system to a robot, so that the light-emitting elements on the temporary palette are arranged on a taping.

19 Claims, 3 Drawing Sheets

METHOD AND APPARATUS FOR ARRANGING LIGHT-EMITTING DIODES AND LIGHT-EMITTING ELEMENTS

The present application is based on Japanese Patent Application No. 2002-201358, the entire contents of which are incorporated herein by reference.

BACKGROUND OF THE INVENTION

1. Field of the Invention

The present invention relates to a method and apparatus for arranging light-emitting diodes (LEDs) or light-emitting elements to be supplied so that characteristics of adjacent LEDs or light-emitting elements in a display or the like are made substantially equal.

Incidentally, in this specification, an LED chip per se is referred to as "light-emitting element" and an integrated device including an optical device such as a package resin or a lens system mounted with the LED chip is referred to as "light-emitting diode" or "LED".

2. Description of Related Art

After characteristics of produced LEDs are once inspected, the LEDs are arranged in inspecting order or at random and supplied to a customer. For example, taping as shown in FIG. 4 is used as a supply method. In this method, results of characteristic inspection are ranked into some grades by a certain characteristic (e.g., light intensity). LEDs 11 of the same rank are put on a corrugated board tape 14 through leads 12 extended from light-emitting portions 13. The leads 12 are stuck onto the corrugated board tape 14 by a pressure-sensitive adhesive tape 15 from above so that the LEDs 11 are fixed. The term "ranking" means classification of the light-emitting elements/LEDs by a certain width with respect to a certain characteristic value.

The method is also applied to the stage of light-emitting elements. That is, light-emitting elements 18 of the same rank as a result of characteristic inspection of the light-emitting elements are put on a palette 16 having a plurality of concave portions 17 arranged as shown in FIG. 5.

Each of the ranks is however considerably wide. Accordingly, when a plurality of LEDs of the same rank in light intensity are arranged in use, there maybe a disadvantage that light intensity varies because an LED high in light intensity in the rank and an LED low in light intensity in the rank are arranged so as to be adjacent to each other. In such a case, a resistor must be applied to the LED high in light intensity to balance light intensity as a whole. This is very trouble some. The same thing occurs in values of characteristics such as forward voltage and wavelength of emitted light. Even in the case where LEDs or light-emitting elements of the same rank are arranged in use, there is a problem that uneven appearance is caused by variation in light emission because characteristics of adjacent LEDs/light-emitting elements vary.

Therefore, an object of the invention is to provide a method and apparatus for arranging LEDs and light-emitting elements to make characteristics of adjacent LEDs/light-emitting elements substantially equal without variation. Incidentally, the invention may be applied to arrangement of light-emitting elements/LEDs produced but unsorted and may be applied to arrangement of light-emitting elements/LEDs ranked in advance.

The invention provides a method of arranging LEDs, including the steps of: performing characteristic measurement on LEDs to thereby obtain required characteristic values of the LEDs and storing the measured characteristic values in accordance with the LEDs; temporarily keeping the LEDs after storing the characteristic values; and rearranging a required number of LEDs to make the required characteristic values of adjacent LEDs substantially equal at a point of time when the required number of LEDs are collected.

In this method, all characteristic values of LEDs are stored in accordance with the LEDs after the values of one of characteristics (such as light intensity, forward voltage, and wavelength of emitted light) of the LEDs, which values being required to be made uniform, are measured. Then, the LEDs are temporarily kept and rearranged so that the characteristic values of adjacent LEDs are made substantially equal at a point of time when a required number of LEDs are collected.

Accordingly, when the LEDs supplied to a customer or to the next process are used in the arranging order, adjacent LEDs can emit light in a uniform manner without variation because the LEDs are arranged to make the characteristic values of adjacent LEDs substantially equal.

In this manner, because the characteristics of adjacent LEDs are made substantially equal, there can be provided a method for arranging LEDs without variation in characteristic.

In the method of arranging LEDs according to the invention, preferably, adjacent LEDs are arranged so that the characteristic value of one LED is not larger than that of the other LED.

Accordingly, the LEDs are arranged from the smallest characteristic value to the largest characteristic value, so that the difference between characteristic values of adjacent LEDs is minimized as a whole. In this manner, because the characteristics of adjacent LEDs are made substantially equal, there can be provided a method for arranging LEDs without variation in characteristic.

The invention also provides a method of arranging light-emitting elements, including the steps of: performing characteristic measurement on light-emitting elements to thereby obtain required characteristic values of the light-emitting elements and storing the measured characteristic values in accordance with the light-emitting elements; temporarily keeping the light-emitting elements after storing the characteristic values; and rearranging a required number of light-emitting elements to make the required characteristic values of adjacent light-emitting elements substantially equal at a point of time when the required number of light-emitting elements are collected.

In this method, all characteristic values of light-emitting elements are stored in accordance with the light-emitting elements after the values of one of characteristics (such as light intensity, forward voltage, and wavelength of emitted light) of the light-emitting elements, which values being required to be made uniform, are measured. Then, the light-emitting elements are temporarily kept and rearranged so that the characteristic values of adjacent light-emitting elements are made substantially equal at a point of time when a required number of light-emitting elements are collected.

Accordingly, when the light-emitting elements supplied to a customer or to the next process are used in the arranging order, adjacent light-emitting elements can emit light in a uniform manner without variation because the light-emitting elements are arranged to make the characteristic values of adjacent light-emitting elements substantially equal.

In this manner, because the characteristics of adjacent light-emitting elements are made substantially equal, there can be provided a method for arranging light-emitting elements without variation in characteristic.

In the method of arranging light-emitting elements according to the invention, preferably, adjacent light-emitting elements are arranged so that the characteristic value of one light-emitting element is not larger than that of the other light-emitting element.

Accordingly, the light-emitting elements are arranged from the smallest characteristic value to the largest characteristic value, so that the difference between characteristic values of adjacent light-emitting elements is minimized as a whole. In this manner, because the characteristics of adjacent light-emitting elements are made substantially equal, there can be provided a method for arranging light-emitting elements without variation in characteristic.

The invention further provides an apparatus of arranging LEDs, including: a characteristic value measuring unit for performing characteristic measurement on LEDs to thereby obtain required characteristic values of the LEDs; a temporarily keeping unit for temporarily keeping the LEDs subjected to the characteristic measurement while giving numbers to the LEDs in measuring order; a characteristic value storage unit for storing the characteristic values of the LEDs in association with the numbers of the LEDs; an arrangement sequence calculation unit for remaking an arrangement sequence of the LEDs by computer so that the difference between the characteristic values of adjacent ones of the LEDs is minimized throughout all the LEDs; and a moving arrangement unit for moving the LEDs from the temporarily keeping unit to a regular supply unit and arranging the LEDs in accordance with the arrangement sequence remade by the arrangement sequence calculation unit.

In this manner, in the apparatus for arranging LEDs according to the invention, values of one of characteristics (such as light intensity, forward voltage, and wavelength of emitted light) of the LEDs, which values being required to be made uniform, are measured by the characteristic value measuring unit and the LEDs are kept by the temporarily keeping unit while temporary numbers are given to the LEDs respectively. Because the characteristic values of the LEDs are stored by the characteristic value storage unit in association with the temporary numbers, an arrangement sequence of the LEDs is remade by the arrangement sequence calculation unit so that the difference between the characteristic values of adjacent LEDs is minimized as a whole. The LEDs are moved from the temporarily keeping unit to a regular supply unit (taping, palette, sheet, etc.) and arranged in accordance with the arrangement sequence by the moving arrangement unit.

Accordingly, when the LEDs supplied to a customer or to the next process are used in the arranging order in the supply unit, adjacent LEDs can emit light in a uniform manner without variation because the LEDs are arranged to make the characteristic values of adjacent LEDs substantially equal.

In this manner, because the characteristics of adjacent LEDs are made substantially equal, there can be provided an apparatus for arranging LEDs without variation in characteristic.

In the apparatus of arranging LEDs according to the invention, preferably, adjacent LEDs are arranged so that the characteristic value of one LED is not larger than that of the other LED.

Accordingly, the LEDs are arranged from the smallest characteristic value to the largest characteristic value, so that the difference between characteristic values of adjacent LEDs is minimized as a whole. In this manner, because the characteristics of adjacent LEDs are made substantially equal, there can be provided an apparatus for arranging LEDs without variation in characteristic.

The invention further provides an apparatus of arranging light-emitting elements, including: a characteristic value measuring unit for performing characteristic measurement on light-emitting elements to thereby obtain required characteristic values of the light-emitting elements; a temporarily keeping unit for temporarily keeping the light-emitting elements subjected to the characteristic measurement while giving numbers to the light-emitting elements in measuring order; a characteristic value storage unit for storing the characteristic values of the light-emitting elements in association with the numbers of the light-emitting elements; an arrangement sequence calculation unit for remaking an arrangement sequence of the light-emitting elements by computer so that the difference between the characteristic values of adjacent ones of the light-emitting elements is minimized throughout all the light-emitting elements; and a moving arrangement unit for moving the light-emitting elements from the temporarily keeping unit to a regular supply unit and arranging the light-emitting elements in accordance with the arrangement sequence remade by the arrangement sequence calculation unit.

In this manner, in the apparatus for arranging light-emitting elements according to the invention, values of one of characteristics (such as light intensity, forward voltage, and wavelength of emitted light) of the light-emitting elements, which values being required to be made uniform, are measured by the characteristic value measuring unit and the light-emitting elements are kept by the temporarily keeping unit while temporary numbers are given to the light-emitting elements respectively. Because the characteristic values of the light-emitting elements are stored by the characteristic value storage unit in association with the temporary numbers, an arrangement sequence of the light-emitting elements is remade by the arrangement sequence calculation unit so that the difference between the characteristic values of adjacent light-emitting elements is minimized as a whole. The light-emitting elements are moved from the temporarily keeping unit to a regular supply unit (taping, palette, sheet, etc.) and arranged in accordance with the arrangement sequence by the moving arrangement unit.

Accordingly, when the light-emitting elements supplied to a customer or to the next process are used in the arranging order in the supply unit, adjacent light-emitting elements can emit light in a uniform manner without variation because the light-emitting elements are arranged to make the characteristic values of adjacent light-emitting elements substantially equal.

In this manner, because the characteristics of adjacent light-emitting elements are made substantially equal, there can be provided an apparatus for arranging light-emitting elements without variation in characteristic.

In the apparatus of arranging light-emitting elements according to the invention, preferably, adjacent light-emitting elements are arranged so that the characteristic value of one light-emitting element is not larger than that of the other light-emitting element.

Accordingly, the light-emitting elements are arranged from the smallest characteristic value to the largest characteristic value, so that the difference between characteristic values of adjacent light-emitting elements is minimized as a whole. In this manner, because the characteristics of adjacent light-emitting elements are made substantially equal, there can be provided an apparatus for arranging light-emitting elements without variation in characteristic.

DETAILED DESCRIPTION OF THE PREFERRED EMBODIMENTS

Embodiments of the invention will be described below with reference to the drawings.

Embodiment 1

Figure 1:
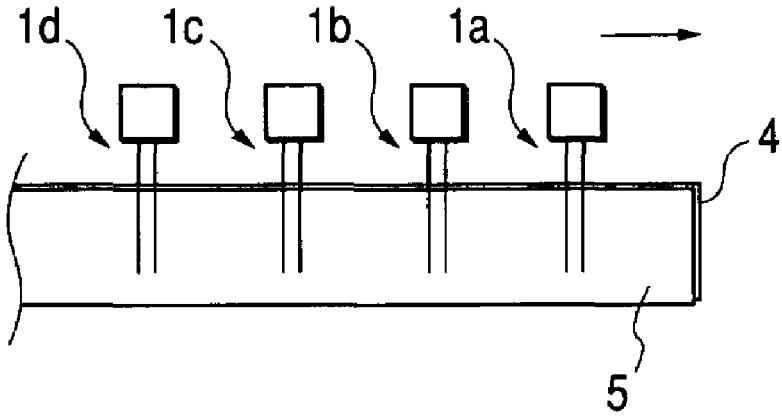
FIG. 1 is a front view showing a method for arranging LEDs according to Embodiment 1 of the invention.

Embodiment 1 of the invention will be first described with reference to FIG. 1. FIG. 1 is a front view showing a method for arranging LEDs according to Embodiment 1 of the invention.

Characteristics such as light intensity, forward voltage, and chromaticity of LEDs 1*a*, 1*b*, 1*c*, 1*d*, . . . as finished products are inspected by a characteristic inspecting unit. Then, the LEDs 1*a*, 1*b*, 1*c*, 1*d*, . . . are arranged successively in a temporarily keeping place. When a required number of LEDs are collected, the LEDs are rearranged so that light intensity values of adjacent LEDs are made substantially equal. That is, the LEDs are sorted according to predetermined algorithm on the basis of the light intensity values of the LEDs stored in a computer so that light intensity values of adjacent LEDs are made substantially equal.

When, for example, the light intensity values of LEDs 1*b* and 1*c* shown in FIG. 1 are 100 mcd and 101 mcd respectively, the two LEDs 1*b* and 1*c* are imaginarily rearranged on a memory of the computer so that the two LEDs 1*b* and 1*c* become adjacent to each other on the memory. When the arrangement sequence of all LEDs is decided, the LEDs are taped up as shown in FIG. 1 so that the LEDs are actually arranged according to the arrangement sequence. For example, the LEDs taped up in this manner are arranged so that the light intensity of the LED 1*a* is 101.5 mcd, the light intensity of the LED 1*b* is 100 mcd, the light intensity of the LED 1*c* is 101 mcd, the light intensity of the LED 1*d* is 101.8 mcd, . . . , that is, the light intensity difference between adjacent LEDs is not larger than 1.5 mcd. Accordingly, when the LEDs taped up in this manner are supplied to a customer, the LEDs can be arranged in a display or the like in order from the LED 1*a* at a starting end of the arrangement sequence so that the light intensity values of adjacent LEDs are made substantially equal without variation.

Variation in forward voltage, chromaticity (wavelength of emitted light), etc. as well as variation in light intensity can be prevented when the LEDs are arranged in the same manner as described above.

As described above, in the method for arranging LEDs according to Embodiment 1, characteristics of adjacent LEDs can be made substantially equal without variation.

Incidentally, the method for arranging LEDs may be modified as follows. That is, LEDs are ranked by a required characteristic (e.g., light intensity). Then, LEDs of the same rank are temporarily numbered (1), (2), (3), (4), (5), (6), . . . in characteristic inspecting order and arranged successively in a temporarily keeping place. When a required number of LEDs of the same rank are collected, the LEDs are rearranged so that the light intensity values of adjacent LEDs are made substantially equal.

Embodiment 2

Figure 2:
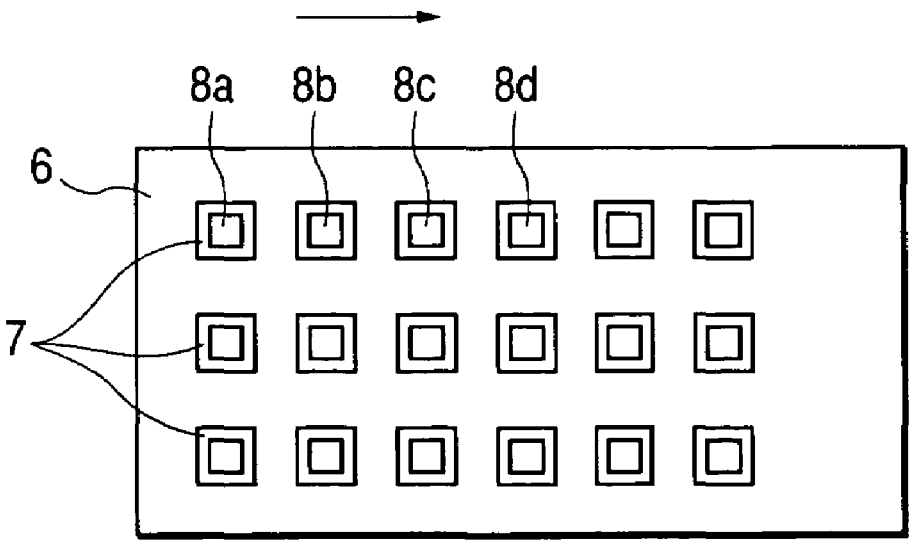
FIG. 2 is a front view showing a method for arranging light-emitting elements according to Embodiment 2 of the invention.

Next, Embodiment 2 of the invention will be described with reference to FIG. 2. FIG. 2 is a plan view showing a method for arranging light-emitting elements according to Embodiment 2 of the invention.

Characteristics such as light intensity, forward voltage, and chromaticity of light-emitting elements (LED chips) 8*a*, 8*b*, 8*c*, 8*d*, . . . as finished products are inspected by a characteristic inspecting unit. Then, the light-emitting elements 8*a*, 8*b*, 8*c*, 8*d*, . . . are arranged successively on a temporary palette. When a required number of light-emitting elements are collected, the light-emitting elements are rearranged so that light intensity values of adjacent light-emitting elements are made substantially equal. That is, the light-emitting elements are sorted according to predetermined algorithm on the basis of the light intensity values of the light-emitting elements stored in a computer so that light intensity values of adjacent light-emitting elements are made substantially equal.

Then, the light-emitting elements 8*a*, 8*b*, 8*c*, 8*d*, . . . are successively received in concave portions 7 of a regular palette 6 in accordance with the decided arrangement sequence. When in use, the light-emitting elements 8*a*, 8*b*, 8*c*, 8*d*, . . . are used in the direction of the arrow shown in FIG. 2 in accordance with the arrangement sequence. After the use of the first row of light-emitting elements is completed, the use of the second row of light-emitting elements is started from the forefront of the second row. In this manner, the light intensity values of adjacent light-emitting elements can be made substantially equal so that no variation in light intensity is generated among the light-emitting elements.

Variation in forward voltage, chromaticity (wavelength of emitted light), etc. as well as variation in light intensity can be prevented when the light-emitting elements are arranged in the same manner as described above.

As described above in the method for arranging light-emitting elements according to Embodiment 2, characteristics of adjacent light-emitting elements can be made substantially equal without variation.

Incidentally, the method for arranging light-emitting elements may be modified as follows. That is, light-emitting elements are ranked by a required characteristic (e.g., light intensity). Then, light-emitting elements of the same rank are temporarily numbered (1), (2), (3), (4), (5), (6), . . . in characteristic inspecting order and arranged successively in a temporarily keeping place. When a required number of light-emitting elements of the same rank are collected, the light-emitting elements are rearranged so that the light intensity values of adjacent light-emitting elements are made substantially equal.

Embodiment 3

Figure 3:
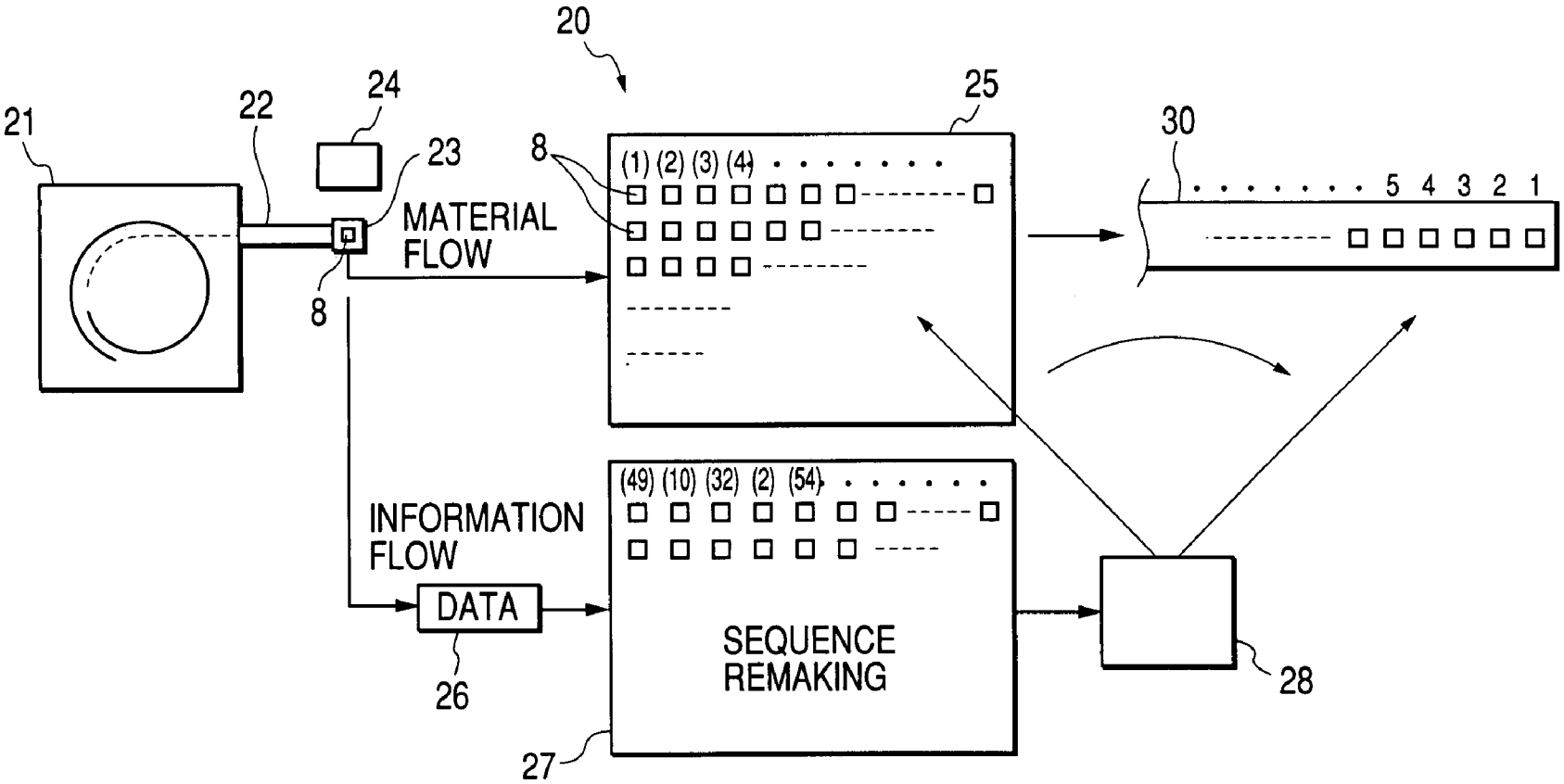
FIG. 3 is a typical view showing the overall configuration of an apparatus for arranging light-emitting elements according to Embodiment 3 of the invention.
Figure 4:
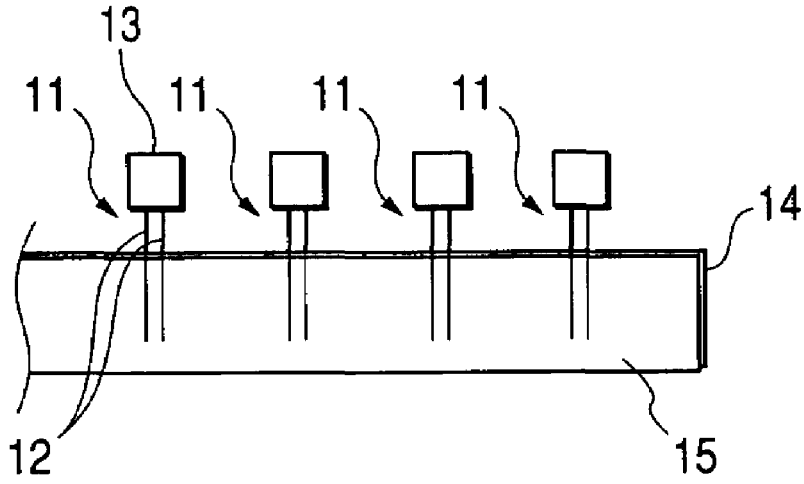
FIG. 4 is a front view showing an example of a method for supplying LEDs according to the related art.
Figure 5:
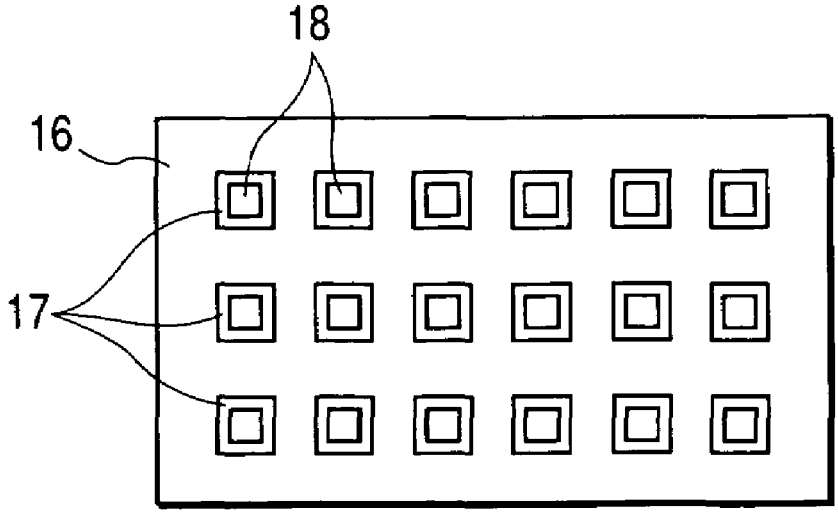
FIG. 5 is a front view showing an example of a method for supplying light-emitting elements according to the related art.

Next, Embodiment 3 of the invention will be described with reference to FIG. 3. FIG. 3 is a typical view showing the overall configuration of an apparatus for arranging light-emitting elements according to Embodiment 3 of the invention.

The apparatus 20 for arranging light-emitting elements according to Embodiment 3 includes a parts feeder 21. Light-emitting elements 8 fed from the parts feeder 21 are one by one put on an inspection stage 23 through a supply line 22 of the parts feeder 21. The light intensity of the light-emitting element 8 put on the inspection stage 23 is measured by an inspection sensor 24 disposed near the inspection stage 23. The inspection sensor 24 is equivalent to the characteristic value measuring unit.

After the measurement, the light-emitting elements 8 are arranged successively on a temporary palette 25 while temporarily numbered (1), (2), (3), (4), . . . in measuring order. The temporary palette 25 is equivalent to the temporarily keeping unit. In parallel with the temporarily keeping operation, measured light intensity data 26 are input to a computer system 27 in association with the temporary numbers (1), (2), (3), (4), . . .

In the computer system 27, the measured light intensity data 26 are rearranged according to predetermined algorithm to make the light intensity values of adjacent light-emitting elements 8 substantially equal, so that the temporary numbers (1), (2), (3), (4), . . . are rearranged on amemory of the computer system 27 in accordance with the rearranged data 26. Then, the rearranged data are sent from the computer system 27 to a robot 28, so that the light-emitting elements 8 on the temporary palette 25 are arranged on a taping 30. The computer system 27 is equivalent to the characteristic value storage unit and the arrangement sequence calculation unit.

The robot 28 first takes out a light-emitting element 8 from the position of the temporary number (49) on the temporary palette 2.5 and puts the light-emitting element 8 on the head (the position of the number 1) of the taping 30. Then, the robot 28 takes out a light-emitting element 8 from the position of the temporary number (10) and put the light-emitting element 8 on the position of the number 2 of the taping 30. Further, the robot 28 takes out a light-emitting element 8 from the position of the temporary number (32) and put the light-emitting element 8 on the position of the number 3 of the taping 30. The operation is repeated in this manner, so that the light-emitting elements 8*a* rearranged successively. The robot 28 is equivalent to the moving arrangement unit. The taping 30 is equivalent to the regular supply unit.

As a result, the light-emitting elements 8 located in the positions of the temporary numbers (49), (10), (32), (2), (54), . . . on the temporary palette 25 are arranged in the positions of the numbers 1, 2, 3, 4, 5, . . . on the taping 30. Accordingly, when in use in a customer or in the next process, the light-emitting elements 8 arranged on the taping 30 are used in the arranging order. In this manner, adjacent light-emitting elements 8 can emit light in a uniform manner without variation because the light-emitting elements 8 are arranged so that the light intensity values of adjacent light-emitting elements 8 are made substantially equal.

As described above, in the apparatus 20 for arranging light-emitting elements according to Embodiment 3, the light intensity values of adjacent light-emitting elements 8 can be made substantially equal without variation. Although the apparatus 20 for arranging light-emitting elements has been described in Embodiment 3, an apparatus for arranging LEDs can be produced in almost the same configuration so that the same operation and effect as described above can be obtained.

Incidentally, the apparatus for arranging light-emitting elements may be modified as follows. That is, light-emitting elements are ranked by a required characteristic (e.g., light intensity). Then, light-emitting elements of the same rank are temporarily numbered (1), (2), (3), (4), (5), (6), . . . in characteristic inspecting order and arranged successively in a temporarily keeping place. When a required number of light-emitting elements of the same rank are collected, the light-emitting elements are rearranged so that the light intensity values of adjacent light-emitting elements are made substantially equal.

Although Embodiment 3 has shown the case where the light-emitting elements 8 are fed by the parts feeder 21, the invention is not limited to this embodiment. Alternatively, light-emitting elements 8 taped up maybe used or light-emitting elements 8 fed manually by an operating person may be used. The unit for supplying the light-emitting elements to a customer or the next process is not limited to the taping 30. Alternatively, a palette, a sheet or the like may be used.

The other steps in the method for arranging LEDs/light-emitting elements, and the configuration, shape, number, material, size, connecting relation, etc. of the other portions in the apparatus for arranging LEDs/light-emitting elements are not limited to those in the embodiments.

As described above, a method of arranging LEDs according to the invention includes the steps of: performing characteristic measurement on LEDs to thereby obtain required characteristic values of the LEDs and storing the measured characteristic values in accordance with the LEDs; temporarily keeping the LEDs after storing the characteristic values; and rearranging a required number of LEDs to make the required characteristic values of adjacent LEDs substantially equal at a point of time when the required number of LEDs are collected.

In this method, all characteristic values of LEDs are stored in accordance with the LEDs after the values of one of characteristics (such as light intensity, forward voltage, and wavelength of emitted light) of the LEDs, which values being required to be made uniform, are measured. Then, the LEDs are temporarily kept and rearranged so that the characteristic values of adjacent LEDs are made substantially equal at a point of time when a required number of LEDs are collected.

Accordingly, when the LEDs supplied to a customer or to the next process are used in the arranging order, adjacent LEDs can emit light in a uniform manner without variation because the LEDs are arranged to make the characteristic values of adjacent LEDs substantially equal.

In this manner, because the characteristics of adjacent LEDs are made substantially equal, there can be provided a method for arranging LEDs without variation in characteristic.

In the method of arranging LEDs according to the invention, preferably, adjacent LEDs are arranged so that the characteristic value of one LED is not larger than that of the other LED.

Accordingly, the LEDs are arranged from the smallest characteristic value to the largest characteristic value, so that the difference between characteristic values of adjacent LEDs is minimized as a whole. In this manner, because the characteristics of adjacent LEDs are made substantially equal, there can be provided a method for arranging LEDs without variation in characteristic.

A method of arranging light-emitting elements according to the invention includes the steps of: performing characteristic measurement on light-emitting elements to thereby obtain required characteristic values of the light-emitting elements and storing the measured characteristic values in accordance with the light-emitting elements; temporarily keeping the light-emitting elements after storing the characteristic values; and rearranging a required number of light-emitting elements to make the required characteristic values of adjacent light-emitting elements substantially equal at a point of time when the required number of light-emitting elements are collected.

In this method, all characteristic values of light-emitting elements are stored in accordance with the light-emitting elements after the values of one of characteristics (such as light intensity, forward voltage, and wavelength of emitted light) of the light-emitting elements, which values being required to be made uniform, are measured. Then, the light-emitting elements are temporarily kept and rearranged so that the characteristic values of adjacent light-emitting elements are made substantially equal at a point of time when a required number of light-emitting elements are collected.

Accordingly, when the light-emitting elements supplied to a customer or to the next process are used in the arranging order, adjacent light-emitting elements can emit light in a uniform manner without variation because the light-emitting elements are arranged to make the characteristic values of adjacent light-emitting elements substantially equal.

In this manner, because the characteristics of adjacent light-emitting elements are made substantially equal, there can be provided a method for arranging light-emitting elements without variation in characteristic.

In the method of arranging light-emitting elements according to the invention, preferably, adjacent light-emitting elements are arranged so that the characteristic value of one light-emitting element is not larger than that of the other light-emitting element.

Accordingly, the light-emitting elements are arranged from the smallest characteristic value to the largest characteristic value, so that the difference between characteristic values of adjacent light-emitting elements is minimized as a whole. In this manner, because the characteristics of adjacent light-emitting elements are made substantially equal, there can be provided a method for arranging light-emitting elements without variation in characteristic.

An apparatus of arranging LEDs according to the invention includes: a characteristic value measuring unit for performing characteristic measurement on LEDs to thereby obtain required characteristic values of the LEDs; a temporarily keeping unit for temporarily keeping the LEDs subjected to the characteristic measurement while giving numbers to the LEDs in measuring order; a characteristic value storage unit for storing the characteristic values of the LEDs in association with the numbers of the LEDs; an arrangement sequence calculation unit for remaking an arrangement sequence of the LEDs by computer so that the difference between the characteristic values of adjacent ones of the LEDs is minimized throughout all the LEDs; and a moving arrangement unit for moving the LEDs from the temporarily keeping unit to a regular supply unit and arranging the LEDs in accordance with the arrangement sequence remade by the arrangement sequence calculation unit.

In this manner, in the apparatus for arranging LEDs according to the invention, values of one of characteristics (such as light intensity, forward voltage, and wavelength of emitted light) of the LEDs, which values being required to be made uniform, are measured by the characteristic value measuring unit and the LEDs are kept by the temporarily keeping unit while temporary numbers are given to the LEDs respectively. Because the characteristic values of the LEDs are stored by the characteristic value storage unit in association with the temporary numbers, an arrangement sequence of the LEDs is remade by the arrangement sequence calculation unit so that the difference between the characteristic values of adjacent LEDs is minimized as a whole. The LEDs are moved from the temporarily keeping unit to a regular supply unit (taping, palette, sheet, etc.) and arranged in accordance with the arrangement sequence by the moving arrangement unit.

Accordingly, when the LEDs supplied to a customer or to the next process are used in the arranging order in the supply unit, adjacent LEDs can emit light in a uniform manner without variation because the LEDs are arranged to make the characteristic values of adjacent LEDs substantially equal.

In this manner, because the characteristics of adjacent LEDs are made substantially equal, there can be provided an apparatus for arranging LEDs without variation in characteristic.

In the apparatus of arranging LEDs according to the invention, preferably, adjacent LEDs are arranged so that the characteristic value of one LED is not larger than that of the other LED.

Accordingly, the LEDs are arranged from the smallest characteristic value to the largest characteristic value, so that the difference between characteristic values of adjacent LEDs is minimized as a whole. In this manner, because the characteristics of adjacent LEDs are made substantially equal, there can be provided an apparatus for arranging LEDs without variation in characteristic.

An apparatus of arranging light-emitting elements according to the invention includes: a characteristic value measuring unit for performing characteristic measurement on light-emitting elements to thereby obtain required characteristic values of the light-emitting elements; a temporarily keeping unit for temporarily keeping the light-emitting elements subjected to the characteristic measurement while giving numbers to the light-emitting elements in measuring order; a characteristic value storage unit for storing the characteristic values of the light-emitting elements in association with the numbers of the light-emitting elements; an arrangement sequence calculation unit for remaking an arrangement sequence of the light-emitting elements by computer so that the difference between the characteristic values of adjacent ones of the light-emitting elements is minimized throughout all the light-emitting elements; and a moving arrangement unit for moving the light-emitting elements from the temporarily keeping unit to a regular supply unit and arranging the light-emitting elements in accordance with the arrangement sequence remade by the arrangement sequence calculation unit.

In this manner, in the apparatus for arranging light-emitting elements according to the invention, values of one of characteristics (such as light intensity, forward voltage, and wavelength of emitted light) of the light-emitting elements, which values being required to be made uniform, are measured by the characteristic value measuring unit and the light-emitting elements are kept by the temporarily keeping unit while temporary numbers are given to the light-emitting elements respectively. Because the characteristic values of the light-emitting elements are stored by the characteristic value storage unit in association with the temporary numbers, an arrangement sequence of the light-emitting elements is remade by the arrangement sequence calculation unit so that the difference between the characteristic values of adjacent light-emitting elements is minimized as a whole. The light-emitting elements are moved from the temporarily keeping unit to a regular supply unit (taping, palette, sheet, etc.) and arranged in accordance with the arrangement sequence by the moving arrangement unit.

Accordingly, when the light-emitting elements supplied to a customer or to the next process are used in the arranging order in the supply unit, adjacent light-emitting elements can emit light in a uniform manner without variation because the light-emitting elements are arranged to make the characteristic values of adjacent light-emitting elements substantially equal.

In this manner, because the characteristics of adjacent light-emitting elements are made substantially equal, there can be provided an apparatus for arranging light-emitting elements without variation in characteristic.

In the apparatus of arranging light-emitting elements according to the invention, preferably, adjacent light-emitting elements are arranged so that the characteristic value of one light-emitting element is not larger than that of the other light-emitting element.

Accordingly, the light-emitting elements are arranged from the smallest characteristic value to the largest characteristic value, so that the difference between characteristic values of adjacent light-emitting elements is minimized as a whole. In this manner, because the characteristics of adjacent light-emitting elements are made substantially equal, there can be provided an apparatus for arranging light-emitting elements without variation in characteristic.

What is claimed is:

1. A method of arranging a number of light-emitting diodes (LEDs), comprising:

storing characteristic values of each of said LEDs measured in a characteristic measurement;

temporarily keeping said LEDs after storing said characteristic values; and rearranging said LEDs to make said characteristic values of adjacent LEDs substantially equal.

2. A method of arranging LEDs according to claim 1, wherein said adjacent LEDs are arranged so that the characteristic value of one LED is not larger than that of another LED.

3. A method of arranging LEDs according to claim 1, wherein a predetermined number of the LEDs are rearranged to make said characteristic values of adjacent LEDs substantially equal, after said LEDs are measured and temporarily kept.

4. A method of arranging LEDs according to claim 1, wherein said characteristic value comprises a light intensity of said LEDs.

5. A method of arranging LEDs according to claim 1, wherein said characteristic value comprises at least one of light intensity, forward voltage, wavelength and chromaticity.

6. A method of arranging LEDs according to claim 1, wherein said LEDs are arranged beginning with an LED having a smallest characteristic value of said LEDs to an LED having a largest characteristic value of said LEDs.

7. A method of arranging LEDs according to claim 1, further comprising:

generating an arrangement sequence on a memory of a computer to make said characteristic values of adjacent LEDs substantially equal, wherein said rearranging is conducted based on said arrangement sequence.

8. A method of arranging LEDs according to claim 1, wherein said temporarily storing comprises ranking each of said LEDs with a temporary number by said characteristic values.

9. A method of arranging LEDs according to claim 1, wherein said rearranging said LEDs comprises sorting said LEDs according to a predetermined algorithm.

10. A method of arranging LEDs according to claim 1, wherein said rearranging said LEDs comprises arranging said LEDs on a tape.

11. A method of arranging LEDs according to claim 1, wherein said rearranging said LEDs comprises arranging said LEDs on a palette.

12. A method of arranging light-emitting elements, comprising:

storing characteristic values of said light-emitting elements measured in a characteristic measurement;

temporarily keeping said light-emitting elements after storing said characteristic values; and rearranging said light-emitting elements to make said characteristic values of adjacent light-emitting elements substantially equal.

13. A method of arranging light-emitting elements according to claim 12, wherein said adjacent light-emitting elements are arranged so that the characteristic value of one light-emitting element is not larger than that of another light-emitting element.

14. A method of arranging light-emitting elements according to claim 12, wherein a predetermined number of the light-emitting elements are rearranged to make said characteristic values of adjacent light-emitting elements substantially equal, after said light-emitting elements are measured and temporarily kept.

15. A method of arranging light-emitting elements according to claim 12, wherein said characteristic value comprises a light intensity of said light-emitting elements.

16. A method of arranging light-emitting elements according to claim 12, wherein said light-emitting elements are arranged beginning with a light-emitting element having a smallest characteristic value of said light-emitting elements to a light-emitting element having a largest characteristic value of said light-emitting elements.

17. A method of arranging light-emitting elements according to claim 12, further comprising:

generating an arrangement sequence on a memory of a computer to make said characteristic values of adjacent light-emitting elements substantially equal, wherein said rearranging is conducted based on said arrangement sequence.

18. A method of arranging light-emitting elements according to claim 12, wherein said temporarily storing comprises ranking said light-emitting elements with a temporary number by said characteristic value.

19. An apparatus for arranging a number of LEDs, comprising:

a characteristic value measuring unit that performs a characteristic measurement on the LEDs to obtain a characteristic value for the LEDs;

an arrangement sequence calculation unit that generates an arrangement sequence of the LEDs such that a difference between the characteristic value of adjacent LEDs is minimized; and a rearrangement unit for rearranging the LEDs in accordance with said arrangement sequence.

* * * * *